US006189251B1

(12) United States Patent
Wilson

(10) Patent No.: US 6,189,251 B1
(45) Date of Patent: Feb. 20, 2001

(54) ART TAPESTRY ENVIRONMENTALLY STABILIZED WITH A HONEYCOMB BOARD RIGID FOUNDATION

(75) Inventor: Heather Wilson, 144-219 Broadway, Laguna Beach, CA (US) 92651

(73) Assignee: Heather Wilson, Laguna Beach, CA (US)

( * ) Notice: Under 35 U.S.C. 154(b), the term of this patent shall be extended for 0 days.

(21) Appl. No.: 08/998,409

(22) Filed: Dec. 24, 1997

(51) Int. Cl.[7] ..... A47G 1/06
(52) U.S. Cl. ..... 40/757; 40/768
(58) Field of Search ..... 40/757, 768, 777, 40/798

(56) References Cited

U.S. PATENT DOCUMENTS 196,027 * 10/1877 Lewis ..... 40/768
321,668 * 7/1885 Wirths ..... 40/768
762,787 * 6/1904 Wheeler ..... 40/768
1,307,394 * 6/1919 Einstein ..... 40/777
1,971,923 * 8/1934 Stern ..... 40/768
3,879,874 * 4/1975 Broussard, Sr. ..... 40/768

* cited by examiner

*Primary Examiner*—Cassandra H. Davis
(74) *Attorney, Agent, or Firm*—Stetina Brunda Garred & Brucker

(57) ABSTRACT

A wall-hanging art-tapestry comprises, for example, a Giclée print of original art reproduced with extreme high fidelity on a textured watercolor paper mounted on a honeycomb board. Canvas is used to cover the back of the board and upholstery velvet edgings are used to edge and cover three sides of the perimeter. An antiqued wood rod with end mounted resin finials are stapled with a fifty percent board compression at each staple across the top and in front of the artwork. A cord is attached at each end of the rod for hanging and tassels are added to complete a tapestry look to the whole construction.

10 Claims, 3 Drawing Sheets

ART TAPESTRY ENVIRONMENTALLY STABILIZED WITH A HONEYCOMB BOARD RIGID FOUNDATION

BACKGROUND OF THE INVENTION

1. Field of the Invention

Figure 1:
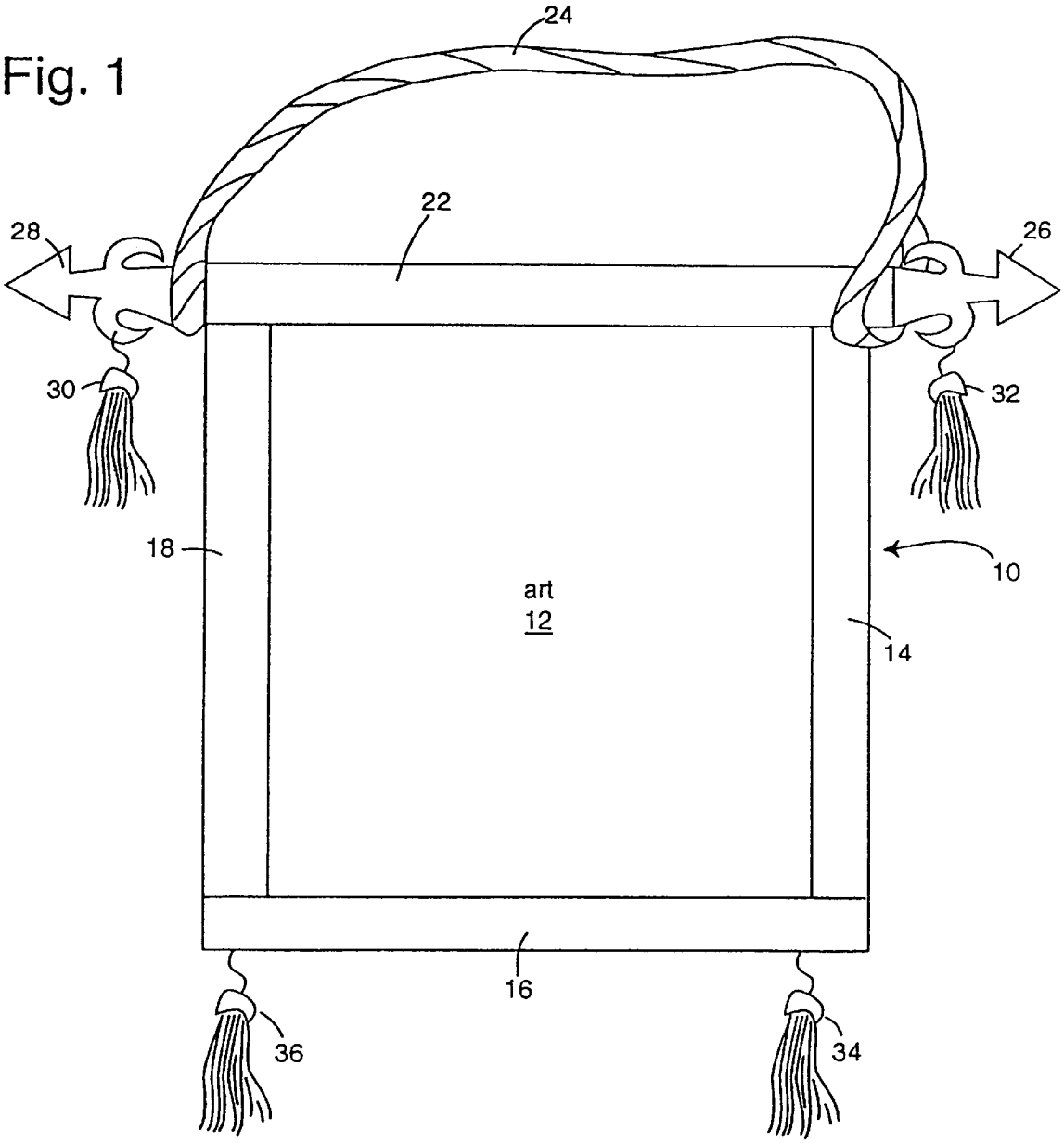

The invention relates generally to hanging wall decorations and more specifically to tapestries with high fidelity reproductions of original artwork and that remain flat and stable over a range of temperatures and humidity.

2. Description of the Prior Art

Most 19th-century tapestries reproduced paintings or previously woven designs. The Industrial Revolution introduced new tools, materials, dyes, and the new middle-class market and its demands. Traditionally, tapestry designs are built up in the course of weaving the decorative fabric. The term tapestry has been applied to any heavy material used to cover furniture, walls, or floors or even to decorate garments. Its narrower, more precise meaning limits its use to heavy, hand-woven textiles usually used for wall hangings or upholstery.

In popular usage, almost any heavy material, hand-woven, machine woven, or even embroidered, used to cover furniture, walls, or floors or for the decoration of clothing, has been called tapestry. Since the 18th and 19th centuries, however, the technical definition of tapestry narrowed to include only heavy, reversible, patterned or figured hand-woven textiles, usually in the form of hangings or upholstery fabric. Tapestry traditionally has been a luxury art afforded only by the wealthy. Even in the 20th century, large-scale hand-woven tapestries were too expensive for those with moderate incomes.

The toile peinte (French: "painted linen"), uses large sheets of heavy, flexible fabric on which a tapestry cartoon has been painted. The cartoon is a full-sized preliminary study from which the finished tapestry is made. Unlike cartoons drawn on paper, toiles peintes were intended to be hung as though they were finished tapestries. Most toiles peintes date from the 16th century in France. The finest collection of old toiles peintes belongs to the Cathedral of Reims. A cartoon originally was and still is a drawing, a full-size pattern for execution in painting, tapestry, mosaic, or other form. The cartoon was the final stage in the series of drawn preparations for painting in traditional Renaissance studio practice. In the early 1840's, the cartoon suddenly acquired a new meaning, that of pictorial parody.

Wool is most widely used material for making the warp, or the parallel series of threads in tapestries that run lengthwise in the fabric. The width-running threads, weft, are also most commonly of wool. Wool is used in the weaving of tapestries because of its availability, workability, durability, and the fact that it can be easily dyed to obtain a wide range of colors. Wool has often been used in combination with linen, silk, or cotton threads for the weft. These materials make possible greater variety and contrast of color and texture and are better suited than wool to detail weaving or to creating delicate effects. In European tapestry, light-colored silks were used to create pictorial effects of tonal gradation and spatial recession. The sheen of silk thread was often used for highlights or to give a luminous effect when contrasted to the dull and darkly colored heavier woolen threads. In 18th-century European tapestries, silk was increasingly used, especially at the Beauvais factory in France, to achieve subtle tonal effects. Most of the Chinese and Japanese tapestries have both warp and weft threads of silk. Pure silk tapestries were also made in the Middle Ages by the Byzantines and in parts of the Middle East. Wholly linen tapestries were made in ancient Egypt, while Copts, or Egyptian Christians, and medieval Europeans sometimes used linen for the warp. Cotton and wool were employed for pre-Columbian Peruvian tapestries as well as for some of the tapestries made in the Islamic world during the Middle Ages. Since the 14th century, European weavers have used gold and silver weft threads along with wool and silk to obtain a sumptuous effect. These threads were made of plain or gilded silver threads wound in a spiral on a silk thread.

Fabrics have been used in room furnishings to help with heating the room by adding insulation. In the primitively heated rooms of the Middle Ages, textiles were used to keep out cold and drafts. In 12th- and 13th-century churches, painted textile drapery can still be discerned beneath the picture friezes. In rather cold churches, just as in poorly heated homes, loosely hung textile wall coverings were of the greatest importance. They were hung loosely because of the practice of taking them down and moving them, together with the relatively few items of furniture, according to need. It was not until the end of the 17th century and during the 18th century that tapestries and other forms of textile wall hanging became fixtures and were fastened to the walls with frames. Wall pictures made of paper and, subsequently, patterned wallpaper became a cheaper substitute for textile wall hangings during the 19th century. Screens or room dividers were often covered with textiles, partly to afford protection against direct radiant heat and partly to create cozy corners in large rooms. Framed screens were often covered with pieces of tapestry, with other woven materials, or with gilt leather.

SUMMARY OF THE PRESENT INVENTION

It is therefore an object of the present invention to provide an art tapestry that is a hybrid between artwork and tapestry.

It is an object of the present invention to provide a decorative art wall furnishing with a tapestry appearance.

It is another object of the present invention to provide a wall-hanging that will lay flat over a variety of temperatures and humidity.

It is a further object of the present invention to provide a wall-hanging that is both light weight and durable.

It is another object of the present invention to provide a wall-hanging that presents every appearance of a very high quality piece of original tapestry art and yet is very affordable and inexpensive to manufacture.

Briefly, a wall-hanging tapestry embodiment of the present invention comprises a Giclée print, or other high fidelity reproduction process, of original art reproduced on a textured water color paper mounted on a paper-faced paper honeycomb board. Canvas is used to cover the back of the board and upholstery velvet edgings are used to edge and cover three sides of the perimeter. An antiqued wood rod with end mounted resin finials are stapled with a fifty percent board compression at each staple across the top and in front of the artwork. A cord is attached at each finial end of the rod for hanging and tassels are added to complete a tapestry look to the whole construction.

An advantage of the present invention is that it provides a hybrid between artwork traditionally done on watercolor paper, canvas or other standard art surfaces and a tapestry normally consisting of expensive flexible woven materials attached to a rod with decorative finials.

Another advantage of the present invention is that a decorative art wall furnishing is provided with a tapestry appearance and that is easy to hang on a wall. Unlike tapestries, it can also be displayed on easels or drop hung from ceilings or beams without curling or warping.

A further advantage of the present invention is that a wall-hanging is provided that will lay flat over a variety of temperatures and humidity.

An advantage of the present invention is that an art tapestry is provided that has a honeycomb core that makes it structurally possible to merge high resolution artwork on watercolor paper or other paper or canvas with a conventional tapestry format embodying a supporting rod, hanging cord and finials. The honeycomb core allows this art tapestry hybrid to be flat over a variety of temperatures and humidity.

A further advantage of the present invention is that the art tapestry has a different textural quality than conventional tapestries made from woven material. It also has the appearance of an expensive complex original mixed-media painting with a higher fidelity of color and detail than that seen in conventional tapestries.

These and many other objects and advantages of the present invention will no doubt become obvious to those of ordinary skill in the art after having read the following detailed description of the preferred embodiments which are illustrated in the drawing figures.

IN THE DRAWINGS

Figure 2:
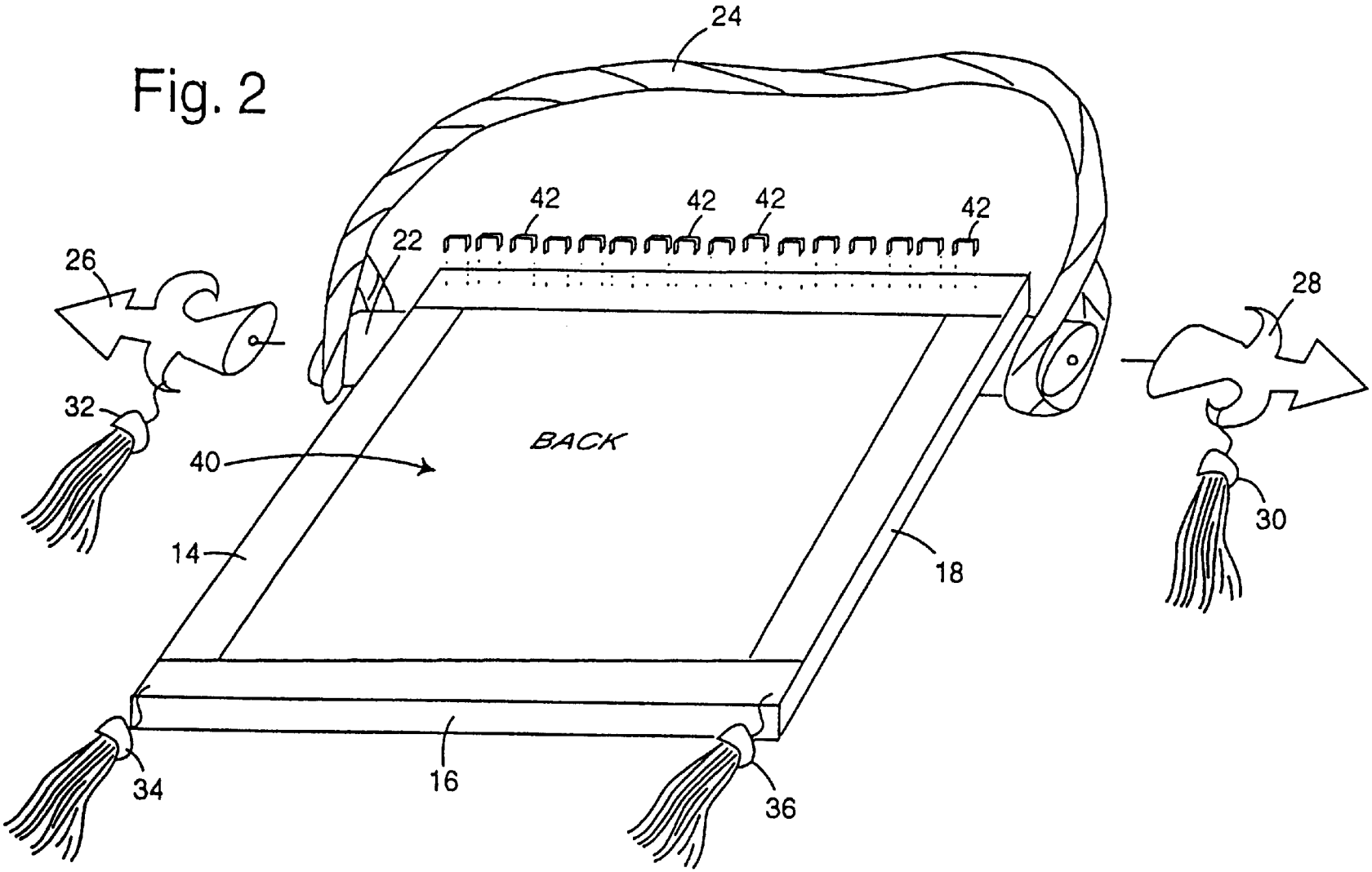
Figure 3:
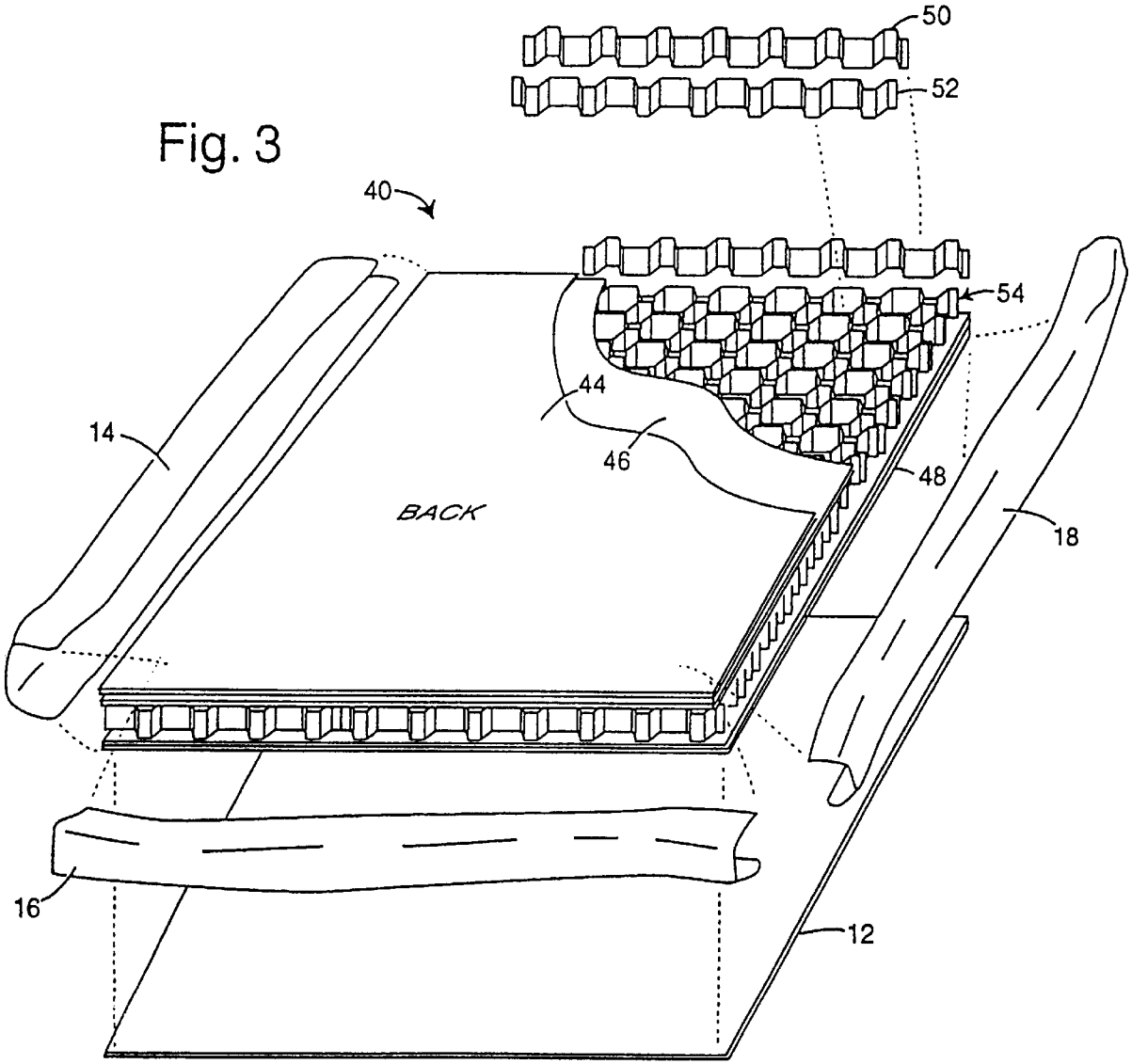

FIG. 1 is a front view of a wall-hanging tapestry embodiment of the present invention;

FIG. 2 is a rear perspective view of the wall-hanging tapestry of FIG. 1 showing the attachment of the finials and cord to the rod, and the rod to the backing board; and FIG. 3 is a rear perspective view of the wall-hanging tapestry of FIG. 1 showing the internal paper honeycomb construction of the backing board and the attachment of the upholstery velvet edgings used to edge and cover three sides of the perimeter.

DETAILED DESCRIPTION OF THE PREFERRED EMBODIMENTS

FIG. 1 illustrates a wall-hanging art-tapestry embodiment of the present invention, referred to herein by the general reference numeral 10. The tapestry 10 comprises a Giclee print 12 which is bordered on three sides by a set of upholstery-velvet strip edgings or borders 14, 16, and 18. A round rod 22 has a tapestry hanging cord 24 attached, and each end is fitted with one of a pair of finials 26 and 28. A set of tassels 30, 32, 34, and 36 complete a tapestry "look".

The Giclée print 12 preferably comprises a reproduction artpiece done by inkjet printing on a textured watercolor paper. An original piece of art, e.g., an oil painting, is digitized by a color computer scanner onto a disk or other memory. A high resolution inkjet printer, e.g., an Iris Graphics model 3047, is loaded with a computer file from the disk memory and the color balance is adjusted to suit artistic tastes. The reproduction image of the original artwork is "Giclée printed". No screens are used in this process, so the resulting prints have a higher apparent resolution than lithographs. For example, fabric and other textures that were visible in the original artwork will typically be reproduced with great fidelity. The dynamic color range is greater than serigraphy. In the Giclée process, a fine stream of ink, more than four million droplets per second, is conventionally sprayed onto archival art paper or canvas. The effect is similar to an air brush technique, but much finer. The artist's color approval and input are essential for creating the final custom settings for the edition.

While almost everyone in the litho printing world knows what an Iris printer is, there has been a need to differentiate the emerging fine art use for the machine. Recently, artists and publishers in the United States have started to use the word "Giclée," and is believed to have been coined by the manufacturers of the printers. The main difference between a Giclée and an ordinary print is in the inks and papers that are used. The standard Iris inks were designed to represent normal litho inks so that they can be used as "proofs" for that kind of printing. Since proofs are typically discarded as soon as the job goes to press, there was little interest in the inks being suitable for archives.

The Iris 3047 Printer is a product of Iris Graphics, Inc. (Bedford, Mass.) which is a company of Scitex Corporation Ltd. (Herzlia B, Israel). The Iris 3047 Printer is for designers and lithographic repro companies who use it to make page proofs before they commit to film and plates. This type of proofing is growing in popularity as "computer-to-plate" technology cuts out the film stage altogether, removing the possibility of making "Cromalin" or wet proofs.

For litho proofing, Iris printers use cyan, magenta, yellow and black "key" (CMYK) "four color" inks. The printing paper is taped to a rotating drum, and the individual colors are sprayed onto the surface by an extremely accurate ink jet system which uses quartz crystals in the print nozzles that are electronically vibrated. The vibration breaks the continuous stream of ink into minute droplets about fifteen-microns in diameter. The droplets are electrically charged in a tube to a variety of voltage levels that allows the printer to create variable dot sizes and ink patterns on the paper. The Iris printer sprays one million droplets of ink every second each with a velocity of about 85 miles an hour. The variable dot sizes give a perceived resolution of 1,800 dpi, rendering the image in apparent continuous tone.

The present invention is not limited to the use of Giclée printing. Lithograph, serigraph, and poster printing, and other forms of two-dimensional art reproduction can also be used to achieve the "art tapestry" embodiments described herein.

In preferred embodiments of the present invention, the finials 26 and 28 are made of cast resin, rather than metal. The resin is preferred because it is lighter in weight and is less expensive to manufacture. The round rod 22 is preferably made of wood, in order to simplify its attachment to the tapestry 10 in such a way that its whole length is visible. Both the round rod 22 and the finials 26 and 28 are "antiqued" in the same way. As many as seven colors are applied one color layer at a time using high quality artistic acrylic paints. A first color layer is applied to the round rod 22 and the finials 26 and 28 by soaking a dense but very soft foam pad with the first acrylic paint color. Such foam pad may comprise the type of pliable urethane foam typically used by furniture upholsterers. The round rod 22 and the finials 26 and 28 are pressed into and rolled around in the paint-soaked foam pad. A crumpled tissue is used to remove parts of the paint to achieve a "distressed" look. The round rod 22 and the finials 26 and 28 are then laid aside to dry, and then the process is repeated for each of the remaining colors.

In FIG. 2 a backing board 40 is shown as having its edges sealed and wrapped by the velvet borders 14, 16, and 18. A number of heavy staples 42 are used to secure the backing 40 to the rod 22. It is preferred that the backing be crushed to fifty percent of its thickness when each staple 42 is being installed in order that the resilience of the backing material can be used to keep the attachment very tight.

In FIG. 3, it can be seen that the backing board 40 preferably comprises a canvas covering 44 that is glued to a paper-faced paper honeycomb 46. The artwork 12 is attached to a front surface 48 of the paper-faced paper honeycomb 46. A pair of horizontal strips 50 and 52 are crinkled and glued to one another to form a honeycomb core 54. The paper-faced paper honeycomb 46 may be comprised of commerically available products, e.g., HEXACOMB, or other kraft paper honeycomb as marketed by Tenneco Packaging (Lincolnshire, Ill.). A thinner than standard honeycomb paper may also be custom-made that would provide better results in the present embodiments. For example, a honeycomb inner core with a 0.355 inch thickness is unusual, but such allows the mounted artwork to look more like tapestry and permits the rod to be easily stapled to the top.

In general, the embodiments of the present invention demonstrate a richness of color in the artwork 12 that results from the Giclee printing on textured water color paper. No doubt new papers in development will also provide acceptable results in the future. The velvet borders 14, 16, and 18 add a look quite out of the ordinary for a tapestry. The stiffness and stability provided by the backing 40 is essential to the overall construction and is necessary to prevent cupping and bowing on the wall as the ambient temperature and humidity change. The round rod 22 and the finials 26 and 28 are preferably color-coordinated with one another and with each tapestry design. The cord 24 is a required part that distinguishes the embodiments as a tapestry.

In an alternative embodiment of the present invention, the artwork 12 is replaced with a mirror to construct a mirror tapestry. An advantage of the mirror tapestry is that it is easier to hang than conventional mirrors. All the other details of construction and appearance remain as described herein for the art tapestry 10.

The present invention provides an art tapestry that is less expensive to produce than traditional tapestries and therefore more affordable to the general public.

Although the present invention has been described in terms of the presently preferred embodiments, it is to be understood that the disclosure is not to be interpreted as limiting. Various alterations and modifications will no doubt become apparent to those skilled in the art after having read the above disclosure. For example, other that velvet can be used for the border fabric and still give very good results. Accordingly, it is intended that the appended claims be interpreted as covering all alterations and modifications as fall within the true spirit and scope of the invention.

What is claimed is:

1. A wall-hanging art-tapestry, comprising:

an internal planar core of honeycomb backing board;

a sheet material having an extreme high-fidelity reproduction of original art thereon, the sheet material being mounted directly to the internal planar core such that the sheet material and the internal planar core collectively define an artwork having a top edge, a bottom edge, and opposed side edges;

a set of upholstery velvet edgings which wrap over and extend along at least the bottom and opposed side edges of the artwork; and a rod with end-mounted finials attached to the internal planar core so as to extend along the top edge of the artwork.

2. The art-tapestry of claim 1, wherein:

the rod is attached to the internal planar core by stapling with a fifty percent board compression at each staple.

3. The art-tapestry of claim 1, further comprising:

a cord attached to the rod at each end for hanging the art-tapestry from a support surface; and at least one tassel attached to at least one of the finials and the internal planar core.

4. The art-tapestry of claim 1, further comprising:

a fabric covering a backside of the internal planar core, wherein the honeycomb backing board is concealed within.

5. The art-tapestry of claim 1 wherein:

the rod with end-mounted finials are respectively comprised of wood and resin and that are antiqued in a process in which acrylic paint is loaded into a dense-and-soft foam pad and the rod and finials are pressed into said paint-loaded foam pad and then dabbed by a crumpled cloth;

wherein said process is repeated for a plurality of different colors to achieve a distressed appearance of an antique.

6. A wall-hanging art tapestry, comprising:

an internal planar core of honeycomb backing board;

a Giclee print comprising a textured watercolor paper having original art reproduced with extreme high fidelity thereon, the Giclee print being mounted on said honeycomb backing board such that the Giclee print and the backing board collectively define an artwork having a top edge, a bottom edge, and opposed side edges;

a set of upholstery velvet edgings which wrap around and extend along at least the bottom and opposed side edges of the artwork; and a rod with end-mounted finials attached to the backing board so as to extend along the top edge of the artwork.

7. A wall-hanging art-tapestry, comprising:

a honeycomb backing board;

a Giclee print comprising a textured watercolor paper having original art produced with extreme high fidelity thereon, the Giclee print being mounted on said honeycomb backing board such that the Giclee print the backing board collectivelty define an artwork having a top edge, a bottom edge, and opposed side edges;

a set of upholstery velvet edgings which wrap around and extend along at least the bottom and opposed side edges of the artwork;

a rod with end-mounted finials attached to the backing board so as to extend along the top edge of the artwork by stapling with a 50% board compression at each staple;

a cord attached to the rod at each finial for hanging the art-tapestry from a support surface;

at least one tassel attached to at least one of the finials and the backing board; and a fabric is used to cover a backside of the backing board wherein the honeycomb backing board is concealed within;

wherein, the rod with end-mounted finials are respectively comprised of wood and resin and are antiqued in a process in which acrylic paint is loaded into a dense-and-soft foam pad and the rod and the finials are pressed into said paint-loaded foam pad and then dabbed by a crumpled tissue; and wherein, said process is repeated for a plurality of different colors to achieve a distressed appearance of an antique.

8. A wall-hanging mirror-tapestry, comprising:

an internal planar core of honeycomb backing board;

a mirror comprising a sheet material which is mounted directly to the internal planar core, the mirror and the internal planar core collectively defining a peripheral edge having a top edge portion, a bottom edge portion, and opposed side edge portions;

a set of upholstery velvet edgings which wrap over and extend along at least the bottom and opposed side edge portion of the peripheral edge; and a rod with end-mounted finials attached to the internal planar core so as to extend along the top edge portion of the peripheral edge.

9. The mirror-tapestry of claim 8, wherein:

the rod is attached with a plurality of staples to the internal planar core by a process of stapling that includes a substantial amount of core compression at each staple.

10. The mirror-tapestry of claim 8, further comprising:

a cord attached to the rod at each end for hanging the mirror-tapestry from a support surface; and at least one pair of tassels attached to at least one of the finials and the backing board.

* * * * *